US005270087A

United States Patent [19]

Polsky

[11] Patent Number: 5,270,087

[45] Date of Patent: Dec. 14, 1993

[54] SCRATCH ART SIMULATED STAINED GLASS AND PROCESS OF MAKING SAME

[75] Inventor: Nathan Polsky, Newton Centre, Mass.

[73] Assignee: Scratch-Art Company, Inc., Avon, Mass.

[21] Appl. No.: 796,962

[22] Filed: Nov. 25, 1991

[51] Int. Cl.[5] ..... B44F 1/06

[52] U.S. Cl. ..... 428/38; 428/29; 428/542.8

[58] Field of Search ..... 427/11, 264; 428/38, 428/29, 542.8; 283/72, 100, 102

[56] References Cited

U.S. PATENT DOCUMENTS

| | | | |
|---|---|---|---|
| 2,711,039 | 6/1955 | Wittman | 428/187 |
| 3,420,728 | 1/1969 | Haverstock | 428/38 |
| 4,262,042 | 4/1981 | Bruskin | 428/13 X |
| 4,284,453 | 8/1981 | Endrizzi | 428/151 X |
| 4,368,587 | 1/1983 | Childs | 428/38 X |
| 4,735,827 | 4/1988 | Frank et al. | 428/31 X |
| 4,868,020 | 9/1989 | Grosslight | 428/29 |
| 4,937,103 | 6/1990 | Hess | 428/195 X |
| 4,940,628 | 7/1990 | Lin et al. | 428/195 X |
| 5,089,351 | 2/1992 | Baarns | 428/535 X |

*Primary Examiner*—Henry F. Epstein

*Attorney, Agent, or Firm*—Sheridan, Neimark, Browdy and Neimark

[57] ABSTRACT

A method, workpiece and the product thereof for making simulated stained glass works of art includes a transparent substrate covered on one side by an opaque scratch-removable coating and on the other side by transparent-ink patterns or solid colors. Portions of the opaque coating are removed to reveal through the transparent substrate, underlying transparent-ink patterns. The partially scratched product "drawing" produces an excellent visual appearance simulative of stained glass when held up to light. The finished product can be affixed to a window for continued enjoyment.

12 Claims, 1 Drawing Sheet

SCRATCH ART SIMULATED STAINED GLASS AND PROCESS OF MAKING SAME

FIELD OF THE INVENTION

The invention relates to an art or hobby workpiece and a method for making designs or pictures simulating stained glass using such a workpiece, and more particularly to a method involving scratching away part of an opaque coating to reveal portions of underlying background.

BACKGROUND OF THE INVENTION

Methods are well known in the prior art for scratching a picture through an opaque or dark coating to reveal a color beneath the coating. A prior art product produced by the present inventor utilizes a wood stylus to scratch a picture through a black top coating applied to a suitable colored substrate.

One prior art patent (see Bruskin U.S. Pat. No. 4,262,042) describes a method of producing a picture such as a stained glass panel including a paint removing step. Another prior art reference (see Childs U.S. Pat. No. 4,368,587) describes a method of making color separation plates including the steps of individually scraping a plurality of various solid colored sheets and superimposing the sheets to create offset printing plates. Other scratch-to-sketch products and processes are also known in the prior art (see for example Hess U.S. Pat. No. 4,937,103 which shows the use of a ceramic base).

SUMMARY OF THE INVENTION

It is an object of the present invention to provide a new and aesthetically pleasing art form, enjoyable to perform and producing an individualized work of art.

It is another object of the present invention to provide an easy and safe method and workpiece for making simulated stained glass art effects.

It is a further object of the present invention to provide a method and workpiece for making simulated stained glass art using only a wooden stick or stylus as the scratching tool so that even a young child can safely create beautiful art.

It is still another object of the present invention to provide a finished simulated stained glass art work product which can be affixed to a window pane where incoming light will produce an impressive visual display for continued enjoyment.

Yet a further object of the present invention is to provide an art or hobby workpiece and a method for converting such workpiece to a simulated stained-glass artwork.

The above and other objects are achieved by the workpiece, process and resultant product of the present invention which begins with a transparent flat plastic sheet substrate, preferably rigid. A single or multiple layer coating made with plural, different colored transparent inks is fixed to one side of the transparent substrate while a removable (by scratching with a scratch tool or the like) opaque top coat covers either the opposite side of the transparent substrate or the layer(s) of transparent ink.

Scratching through the opaque top coat will reveal the colors therebeneath or on the opposite side of the transparent substrate. The drawn picture art achieved by selective scratching will thus be opaque except where it has been scratched. When the product is held up to the light, the transparent inks used in the printed substrate will produce visual effects which simulate stained glass.

BRIEF DESCRIPTION OF THE DRAWINGS

Preferred embodiments of the present invention will be described in more detail in the following detailed description when taken in conjunction with the attached drawings, in which.

DETAILED DESCRIPTION OF EMBODIMENTS

Figure 1:
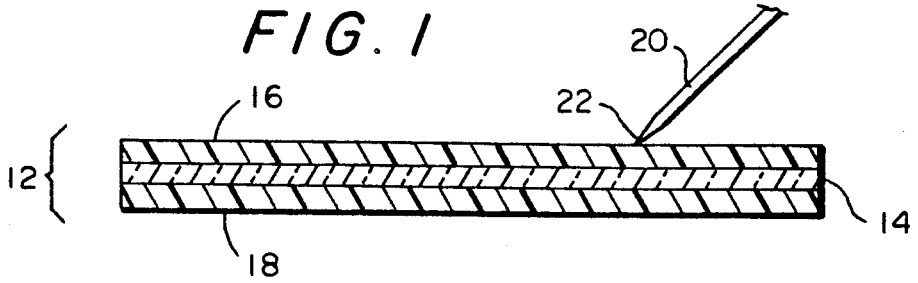
FIG. 1 is a schematic sectional view of coated blank along with a stick tool used to scrape part of the coating from the blank in accordance with a preferred embodiment of the present invention.

A prepared pre-scratch blank or workpiece 12 is shown in FIG. 1, along with a scratch tool 20. The pre-scratch blank 12 is preferably made up of three main layers. The base or middle layer substrate 14 is preferably made of a generally clear transparent or translucent plastic sheet material, such as rigid and unpigmented PVC, cellulose acetate, polystyrene, clear polypropylene, ABS, etc., of at least 3 mils thickness, preferably 3–10 mils thickness. One side of the middle layer 14 is coated or printed with a removable (by scratching with a scratch tool 20 or the like) continuous opaque layer 16, which is preferably black. Onto the opposite side of the clear middle layer substrate 14 is coated or printed a single or, more preferably, multiple color layer 18 which on drying becomes permanently attached to the clear substrate layer 14.

The scratch tool 20 is preferably made of wood and can be as simple as an elongated stick which has preferably had a stylus 22 or point carved into at least one end.

The opaque layer 16 may be formed of any opaque coating material, i.e. one which is not transparent to light. Preferred, however, is a well-known ink known as "malleable black" which is a printing ink known in the printing industry which poorly bonds to whatever surface it is applied. These malleable black inks, which may be of colors other than black, are conventionally used on coin-scratch contest forms to cover a hidden message therebeneath and which are easily scratched away by using the edge of a coin.

When the construction of FIG. 1 is prepared for use by children, i.e. the scratch tool 20 is formed of wood, then the opaque coating must be an easily removable material such as malleable black. On the other hand, if the device of FIG. 1 is constructed for use by adults, wherein the scratch tool 20 is formed of metal and is provided with a sharper stylus 22, more tightly adherent opaque inks can be used. Thus, in place of malleable black, one may use a regular opaque black, e.g. black printers ink. The opaque covering may require two or three printing passes to provide sufficient opacity.

Figure 2:
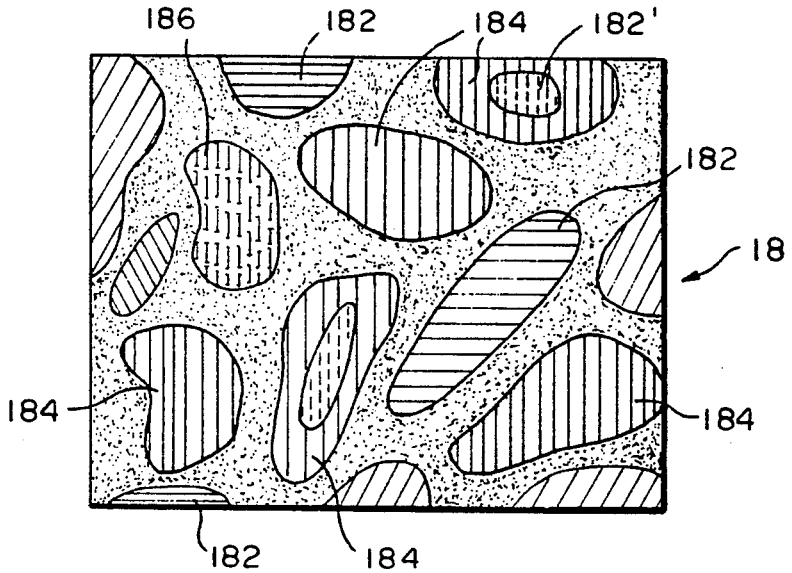
FIG. 2 is a schematic rear or bottom view of a printed pattern on the back side of a blank such as that shown in FIG. 1 all in accordance with the present invention.

The color layer 18 is also desirably printed directly onto the clear substrate layer 14, using conventional printing techniques, such as offset printing, flexographic printing, and silkscreen printing, using conventional transparent overprinting inks. The term "transparent" as used herein is a conventional term for transparent inks conventionally used in the printing industry, and which permit the passage therethrough of light and are therefore suitable for use in the present invention. One or more layers of these conventional transparent printing inks are applied as layer 18 in various patterns, and it is normally necessary to provide only one to three layers, each with one of the three primary colors, namely magenta (red), cyan (blue) and yellow, it being understood that secondary colors are achieved by overprinting. For example, in FIG. 2, areas 182 are printed in blue, areas 184 in red, and 186 in yellow. In the area 182', blue has been printed over red 184, so as to give the secondary color (when light shines therethrough) of violet or purple.

As indicated above, both the opaque coating 16 and the transparent layer or layers 18 can be applied to the transparent substrate 14 using any conventional prior art printing technique. Virtually any pattern or single color can be applied as the printed layer 18, the only requirement being that the ink be "transparent" and adhere adequately to the substrate 14. The design illustrated in FIG. 2 is, of course, only exemplary, it being understood that the number of printed patterns is practically infinite.

Figure 3:
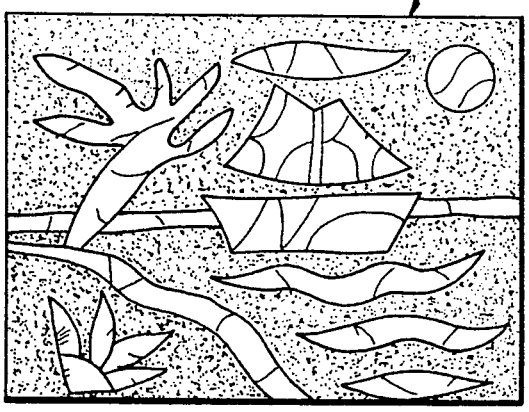
FIG. 3 is a schematic front or top view of a scratched sketch on an art blank such as that shown in FIG. 1 having a rear pattern similar to that shown in FIG. 2 all in accordance with the present invention.
Figure 4:
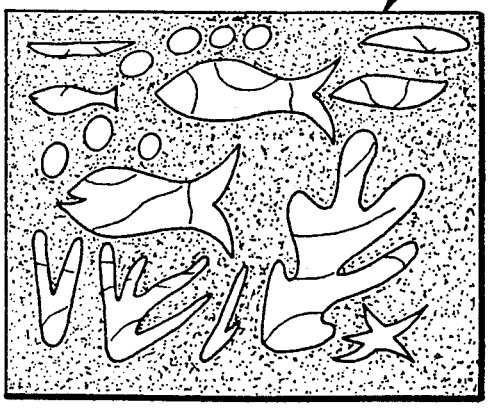
FIG. 4 is another schematic front or top view of a scratched sketch, different from that of FIG. 3, on an art blank such as that shown in FIG. 1 having a rear pattern similar to that shown in FIG. 2 all in accordance with the present invention.

The finished blank 12 is used by scratching through the opaque top blank coat 16 to reveal the colors of the pattern layer 18 on the opposite side of the plastic clear substrate 14. The drawn picture, two examples of which are shown in FIGS. 3 and 4 by reference numerals 16' and 16'' respectively, will be black except where scratched. The black areas of FIGS. 3 and 4 are the unscratched sections and the light areas are the scratched sections which reveal the portions of the underlying pattern 18.

When the scratched blanks 16' or 16'' are held against light and looked at from the scratched side, the transparent inks will provide an effect simulative of stained glass. Transparent colors will appear only where the opaque coating 16 has been scratched off as the light shines through.

Figure 5:
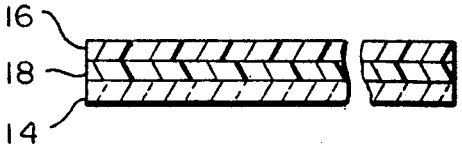
FIG. 5 is a schematic sectional view of another embodiment.

FIG. 5 shows another embodiment, less preferred than the embodiment of FIG. 1, wherein both the transparent ink layer(s) 18, and the opaque overcoating 16 are applied to the same side of the transparent substrate 14. In this embodiment, however, the opaque layer 16 must be formed of a poorly bonding ink or coating composition such as malleable black, and moreover a sharp tool 20 cannot be used, i.e. one can only utilize a relatively dull scratch tool 20 such as one formed of wood.

The above-described invention will greatly simplify and make cost-effective the production of simulated stained glass works of art, such as windows. Furthermore, the invention provides an excellent and novel vehicle for free-hand art in a highly direct method.

Also, by eliminating the need for glass cutting, the present invention will provide great safety advantages. The present invention is safe and easy to use such that even young children can utilize it.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A workpiece for making simulated stained glass art comprising:

a clear, transparent plastic sheet substrate;

a transparent colored ink layer covering a surface of said plastic sheet substrate; and a removable by scratching completely opaque layer covering a surface of said plastic sheet substrate whereby said opaque layer can be partially removed in selected patterns by scratching with a tool to reveal the transparent ink layer supported by said transparent substrate.

2. The workpiece of claim 1 wherein said transparent ink layer is directly printed onto said plastic sheet substrate on a surface opposite the surface on which said opaque layer resides.

3. The workpiece of claim 1 wherein a pattern and more than one color make up the transparent ink layer.

4. The workpiece of claim 3 wherein, after the opaque coating has been partially removed, the product held up to light creates an effect simulative of stained glass.

5. The workpiece of claim 1 wherein said opaque layer is malleable black.

6. The workpiece of claim 5 wherein said transparent ink layer lies directly beneath said opaque layer.

7. A workpiece according to claim 1 wherein said plastic sheet substrate has a thickness of at least 3 mils and is rigid, and wherein said removable-by-scratching completely opaque layer is formed of an ink coating.

8. A product formed by scratching away portions of the opaque layer of the work piece of claim 1, comprising a clear and transparent plastic sheet substrate; a transparent colored ink layer covering a surface of said plastic sheet substrate; and a completely opaque layer covering a portion of said plastic sheet substrate from which said completely opaque layer has not been scratched away.

9. A product according to claim 8 wherein said transparent ink layer is directly adjacent said plastic sheet substrate on a surface opposite the surface on which said opaque layer resides.

10. A product according to claim 8 wherein a pattern and more than one color make up the transparent ink layer.

11. A product according to claim 8 wherein said completely opaque layer is a coating of malleable black.

12. A product according to claim 8 wherein said transparent ink layer lies directly beneath said opaque layer.

* * * * *